US005315362A

United States Patent [19]

Fuji et al.

[11] Patent Number: 5,315,362

[45] Date of Patent: May 24, 1994

[54] MULTICOLOR DEVELOPING DEVICE INCLUDING EXPANSION/CONTRACTION MEANS FOR PERMITTING A DEVELOPING MECHANISM TO MOVE RELATIVE TO ITS ASSOCIATED TONER CONTAINER

[75] Inventors: Kazuo Fuji, Osaka; Hideki Kita, Suita; Toshimitsu Takeuchi, Hirakata, all of Japan

[73] Assignee: Mita Industrial Co., Ltd., Japan

[21] Appl. No.: 794,588

[22] Filed: Nov. 19, 1991

[30] Foreign Application Priority Data

Nov. 27, 1990 [JP] Japan ..... 2-321401

[51] Int. Cl.[5] ..... G03G 15/01

[52] U.S. Cl. ..... 355/326 R; 141/258; 141/279; 222/DIG. 1; 355/246; 355/260

[58] Field of Search ..... 355/326 R, 327, 215, 355/245, 246, 260; 222/DIG. 1; 118/645; 141/256, 258, 259, 279

[56] References Cited

U.S. PATENT DOCUMENTS 4,954,844 9/1990 Morita et al. ..... 355/326 X
5,074,342 12/1991 Kraehn ..... 355/260 X

FOREIGN PATENT DOCUMENTS 018141 10/1980 European Pat. Off. .
371758 6/1990 European Pat. Off. .
2-226266 11/1990 Japan .
2165776 4/1986 United Kingdom .

OTHER PUBLICATIONS

Patent Abstracts of Japan vol. 14, No. 534 (P-1135) Nov. 26, 1990 & JP-A-02 226 266 (Canon).

*Primary Examiner*—A. T. Grimley
*Assistant Examiner*—Shuk Y. Lee
*Attorney, Agent, or Firm*—Beveridge, DeGrandi, Weilacher & Young

[57] ABSTRACT

A movable frame member is so mounted on a stationary frame member as to be movable reciprocatingly. A plurality of developing mechanisms are provided on the movable frame member to perform developing in different colors. The same number of toner containers as the number of developing mechanisms are arranged in a fixed manner, and toner feeders for feeding toner into the corresponding developing mechanisms are provided.

Each of the toner feders includes a toner conveying device for conveying toner to an upper end portion of a cylindrical member, and a toner dropping passage means for feeding toner conveyed to the upper end portion of the cylindrical member to the developing mechanism. The toner dropping, passage includes an expansion/contraction device so disposed as to extend along the moving direction of the developing mechanism.

9 Claims, 2 Drawing Sheets

MULTICOLOR DEVELOPING DEVICE INCLUDING EXPANSION/CONTRACTION MEANS FOR PERMITTING A DEVELOPING MECHANISM TO MOVE RELATIVE TO ITS ASSOCIATED TONER CONTAINER

FIELD OF THE INVENTION

This invention relates to a multicolor developing device, more specifically, a multicolor developing device for use in developing an electrostatic latent image in a color image forming machine such as a color copying machine or a color printing machine.

Description of the Prior Art

In recent years, color images have been in increasing demand, and a number of color image forming machines of the electrostatic type have been proposed and put to practical use. In a typical example of such a color image forming machine, an electrostatic latent image for each of four colors, yellow, magenta, cyan and black, is formed on an electrostatic photosensitive material provided on a rotating drum. Then, the electrostatic latent image is developed by a developing device, and transferred onto a copying paper to form a color image on the copying paper.

The developing device in the color image forming machine as described above is required to be, say, a multicolor developing device capable of selectively developing an electrostatic latent image in the aforementioned four colors.

The multicolor developing device so far known is, for instance, one provided in the color image forming machine disclosed in Japanese Laid-Open Patent Publication No. 148055/1990. This multicolor developing device includes a plurality of developing mechanisms mounted on a movable frame member which is moved reciprocatingly in an up and down direction by a moving means. When the movable frame member is moved in the up and down direction by the moving means, each of the developing mechanisms is positioned selectively in a developing zone of the rotating drum, and each developing mechanism performs a developing action in an individually different color which is one of the aforementioned colors Each of the developing mechanisms includes a development housing and a toner container for holding a toner of an individually different color. Toner in the toner container is fed into the development housing through a toner feeding means during a developing action of the developing mechanism.

The aforementioned conventional multicolor developing device has the following problems to be solved (1) Since the toner container is provided in each of the developing mechanisms mounted on the movable frame member, there is need for a space in which the toner containers move upwards. Accordingly, the volume of the toner container is restricted, and toner must be frequently replenished into the toner container. In addition, this makes the color image forming machine large-sized.

(2) The weight of the whole movable frame member including the developing mechanisms increases, so that an inertia force due to movement becomes great and a load imposed on the moving means increases. Hence, high-speed operation becomes very difficult, and changeover between different developing mechanisms takes time. A motor with a high capacity is required for the movement of the movable frame member.

(3) The volume of toner remaining in the toner container varies, causing changes in the load on the moving means imposed at the time of driving or stopping the movable frame member. Thus, it becomes difficult to ensure full accuracy in the positioning of each developing mechanism and in the timings of driving and stopping.

Multicolor developing devices are also known in which the toner containers are located further above the developing mechanisms, and toner is fed into each developing mechanism via a flexible tube having a built-in spiral. Such devices, however, require a space for locating the toner containers further upward of the uppermost position at which the developing mechanisms arrive. As a result, the whole of the color image forming machine becomes large-sized. Moreover, a considerable useless space forms below each toner container.

SUMMARY OF THE INVENTION

A main object of this invention is therefore to provide an improved multicolor developing device capable of securing a satisfactory volume of the toner containers, and of ensuring a sufficient accuracy of positioning of each developing mechanism while increasing the changeover speed of each developing mechanism.

To attain this main object, the invention provides a multicolor developing device comprising a stationary frame member, a movable frame member so mounted on the stationary frame member as to move reciprocatingly in a predetermined direction by a moving means, and a plurality of developing mechanisms spaced in the predetermined direction and mounted on the movable frame member, each of the developing mechanisms being selectively positioned at a predetermined developing position when the movable frame member has been moved by the moving means, so that each developing mechanism performs a developing action in an individually different color, wherein the same number of toner containers as the number of the developing mechanisms are arranged in a fixed manner, a toner feeding means for feeding a toner held within the toner container into the developing mechanism is provided between each of the toner containers and each of the developing mechanisms corresponding to the toner containers, each of the toner feeding means includes a cylindrical member extending upwardly from a lower end portion of the toner container in the predetermined direction, a toner conveying means which is disposed within the cylindrical member and extends therealong and which is adapted to convey toner that has been supplied to the cylindrical member from the lower end portion of the toner container, to an upper end portion of the cylindrical member, and a toner dropping passage means for connecting the upper end portion of the cylindrical member to the developing mechanism and feeding the toner conveyed to the upper end portion of the cylindrical member into the developing mechanism, each toner conveying means is connected with a driving source which is actuated based on a toner feeding signal, each toner dropping passage means includes an expansion/contraction means adapted to extend substantially along the moving direction of the developing mechanisms, and each expansion/contraction means is so constructed as to be expansible and contractible in the moving direction of the developing mechanisms in accordance with the reciprocating movement of the movable frame member.

Other objects of this invention will become clear from an embodiment of a multicolor developing device constructed in accordance with this invention as will be described in detail with reference to the accompanying drawings.

DETAILED DESCRIPTION OF THE PREFERRED EMBODIMENT

A preferred embodiment of a multicolor developing device improved according to this invention will now be described in detail with reference to the accompanying drawings.

Figure 1:
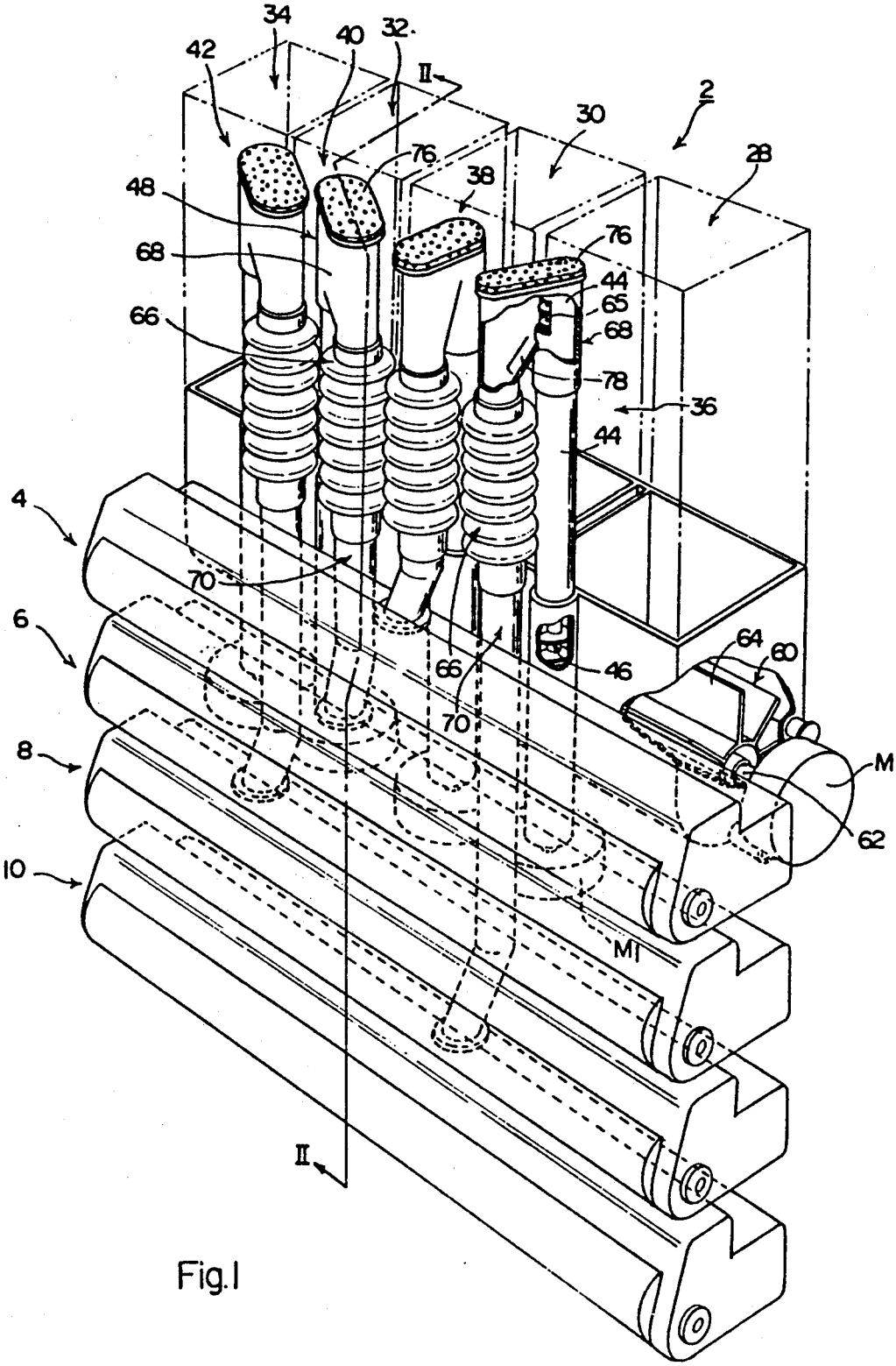
FIG. 1 is a perspective schematic view of a multicolor developing device as an embodiment of this invention, shown in a partially cutaway manner.
Figure 2:
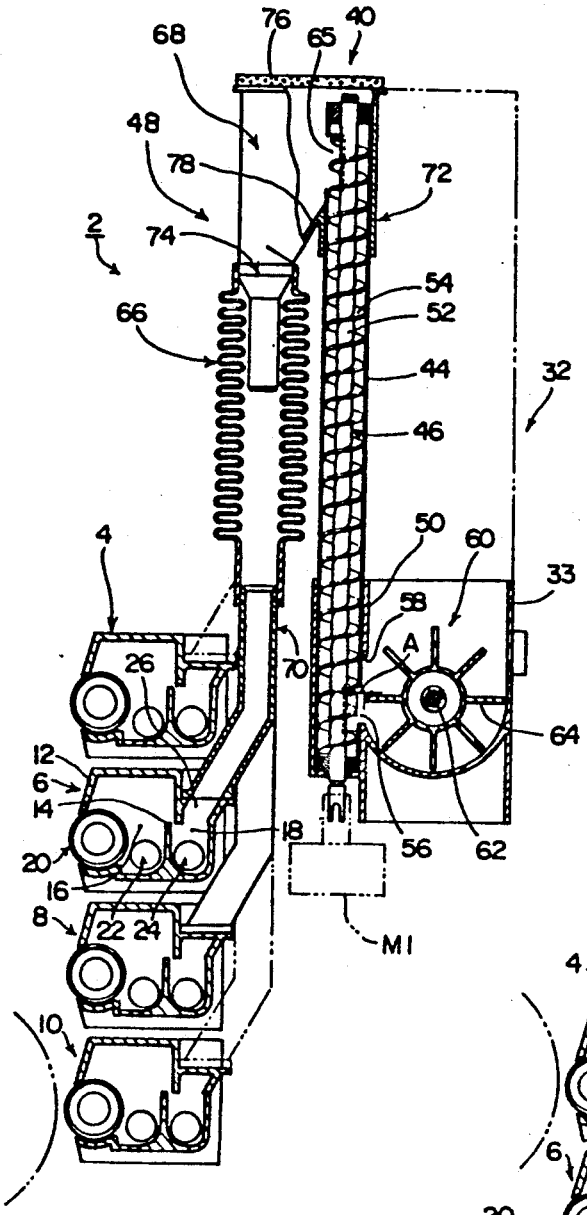
FIG. 2 is a schematic sectional view taken on line II—II of FIG. 1.

In FIGS. 1 and 2, a multicolor developing device indicated entirely at 2 comprises a stationary frame member (not shown) and a movable frame member (a developing mechanism unit; not shown) so mounted on the stationary frame member as to move reciprocatingly by a moving means in a predetermined direction (a vertical direction in this embodiment).

The stationary frame member is constructed entirely of a rectangular parallelopipedal housing, in which the multicolor developing device 2 is disposed. The movable frame member is constructed entirely of a substantially rectangular parallelopipedal housing which has a slender rectangular shape in the up-and-down direction and also a slender rectangular shape in the back-and-forth direction (a direction perpendicular to the sheet surface in FIG. 2). The movable frame member is adapted to move reciprocatingly vertically along a guide rail (not shown) provided on the stationary frame member.

The moving means (not shown) includes, for example, a threaded shaft provided on the stationary frame member and extending vertically, a nut engaged with on the threaded shaft, and a driving source for rotating the threaded shaft. The movable frame member is provided with a connecting bracket, and since the connecting bracket is supported on the nut, the movable frame member is so mounted on the stationary frame member as to move reciprocatingly in the vertical direction by the moving means. Specifically, when the threaded shaft is rotated by the driving source, the nut moves along the threaded shaft. Therefore, the movable frame member is caused to move reciprocatingly in the vertical direction along the guide rail via the connecting bracket. Such moving means is disclosed in a patent application (Japanese Patent Application No. 130395/1990), filed by the instant applicant, and will not be described any more.

In the embodiment described now, four developing mechanisms 4, 6, 8 and 10 are mounted on the movable frame member vertically from above in this order at a predetermined distance between the adjacent developing mechanisms. The developing mechanism 4 accommodates a developer containing a toner of a cyan color; the developing mechanism 6, a developer containing a toner of a yellow color; the developing mechanism 8, a developer containing a toner of a magenta color; and the developing mechanism 10, a developer containing a toner of a black color. The developer comprises, say, the toner and a carrier. The basic constitution of each developing mechanism is substantially the same, with the exception of some parts to be described late on, and so will be described in regard to the developing mechanism 6, for example.

The developing mechanism 6 includes a development housing 12. The development housing 12 has two chambers 16 and 18 formed by a partition wall 14 provided along the back-and-forth direction (longitudinal direction) thereof. The chambers 16 and 18 are communicated with each other via a communicating passage (not shown) at both end portions of the partition wall 14. In the chamber 16 are disposed a sleeve 20 and a spiral roller 22 that is a means for agitating and circulating a developer. In the chamber 18 is disposed a spiral roller 24 that is a means for agitating and circulating a developer.

The sleeve 20 is rotatably supported by the development housing 12, and part of its peripheral surface protrudes from an opening provided along the left end of the development housing 12. When the developing mechanism is positioned at a predetermined developing position, said protruding portion of the peripheral surface of the sleeve 20 approaches a developing zone of a rotating drum (see a two-dot chain line in FIGS. 2 and 3) provided on the stationary frame member, and applies toner (yellow in this embodiment) onto the surface of the rotating drum, thereby performing a developing action.

The spiral rollers 22 and 24 are rotatably supported and extends in parallel with each other in the longitudinal direction of each of the chambers 16 and 18 of the development housing 12. The sleeve 20 and the spiral rollers 22 and 24 are each connected with a driving source (not shown) via a gear train (not shown), so that they can be rotatingly driven simultaneously. When the spiral rollers 22 and 24 are rotated, the developer in the chambers 16 is conveyed longitudinally in a direction reverse to the travel of the developer in the chamber 18. Thus, the developer within the development housing 12 is circulated while being agitated.

At a position upward of the chamber 18 of the development housing 12 is formed a toner receiving opening 26 for receiving toner fed from a toner feeding means which will be described later on. The toner receiving opening 26 is at a position in the upstream side of the spiral roller 24. The position where the toner receiving opening 26 is formed differs according to each developing mechanism. This difference is ascribed to the positional relationship with the toner feeding means, and will be understood more easily from later descriptions.

As has been mentioned, each of the developing mechanisms 4 to 10 is selectively positioned at the predetermined developing position in accordance with the movement of the movable frame member by the moving means, so that each developing mechanism can perform a developing action in an individually different color. Control for movement of the movable frame member by such moving means and developing action may be done in a manner well known to people skilled in the art, and so will not be described any more.

To the stationary frame member on the right end side of the movable frame member are fitted the same number of toner containers 28, 30, 32 and 34 as the number of the developing mechanisms 4 to 10 in a side-by-side relationship in the horizontal direction. These toner containers are mounted on a supporting frame (not shown) provided on the stationary frame member. Between each of the toner containers 28 to 34 and each of the developing mechanisms 4 to 10 corresponding to each of the toner containers is provided each of toner feeding means 36, 38, 40 and 42 for feeding toner within each toner container to each corresponding developing mechanism. The toner container 28 and the toner feeding means 36 are provided in conjunction with the developing mechanism 10. Similarly, the toner container 30 and the toner feeding means 38 are provided in conjunction with the developing mechanism 4; the toner container 32 and the toner feeding means 40, with the developing mechanism 6; and the toner container 34 and the toner feeding means 42, with the developing mechanism 8. Therefore, toner held in the toner container 28 is a black toner; that in the toner container 30, a cyan toner; that in the toner container 32, a yellow toner; and that in the toner container 34, a magenta toner.

The basic constitution of each of these toner containers and toner feeding means s substantially the same, with the exception of their layouts. Therefore, it will be described with reference to the toner container 32 and the toner feeding means 40 provided in association therewith.

The toner feeding means 40 includes a cylindrical member 44 extending upwardly from the lower end portion of a container body 33 of the toner container 32 in a predetermined direction (a vertical direction); a spiral roller 46 as a toner conveying means which is disposed within the cylindrical member 44 and extends therealong and which is adapted to convey toner that has been supplied to the cylindrical member 44 from the lower end portion of the toner container 32, to the upper end portion of the cylindrical member 44; and a toner dropping passage means 48 which connects the upper end portion of the cylindrical member 44 to the developing mechanism 6 and feeds toner conveyed to the upper end portion of the cylindrical member 44 into the developing mechanism 6.

At a side portion of the container body 33 (left side in FIG. 2) is formed a cylindrical supporting portion 50, and a lower end portion of the cylindrical member 44 is inserted into and supported by the supporting portion 50. The spiral roller 46 being a toner conveying means comprises a shaft 52 rotatably supported by bearings provided at an upper end and a lower end of the cylindrical member 44, and a spiral member 54 provided on the shaft 52. The shaft 52 protrudes downwards from the lower end of the cylindrical member 44, and is connected with a motor Ml, a driving source. The motor Ml is controlled so as to be operated based on a toner feeding signal.

At a lower end portion of the cylindrical member 44 is formed a toner inlet opening 56. At that part of the supporting portion 50 of the container body 33 which corresponds to the toner inlet opening 56 is also formed an opening 58. Within the lower end portion (bottom portion) of the container body 33 is provided a rotating blade 60 being a rotating blade means for forcing the toner held in the container body 33 into the lower end portion of the cylindrical member 44. The rotating blade 60 is composed of a rotating shaft 62 extending through the inside of the container body 33 and a plurality of blades 64 provided on the rotating shaft 62. The rotating blade 60 is connected with a motor M, a driving source. The motor M is so controlled as to be operated based on a signal such as a toner feeding signal, an ON signal from the main switch of the copying machine, or a rotating signal for the sleeve of the developing mechanism. When the rotating blade 60 is rotated, toner present in the bottom portion of the container body 33 is forced into the lower end portion of the cylindrical member 44 via the opening 58 and the toner inlet opening 56. To prevent the blocking of toner at the toner inlet opening 56, the distance A between the top end of the rotating blade 60 and the spiral member 54 (see FIG. 2) is set as follows $0<A<10$ (unit: mm). A more preferable condition is $0<A\leqq 2$. At the upper end portion of the cylindrical member 44 is formed a toner outlet opening 65 for discharging toner conveyed by the spiral roller 46 into a connecting housing 68 which will be described later on.

According to this embodiment, the motor M and the rotating shaft 62 are used jointly by the other toner containers 28, 30 and 34, but may, of course, be provided individually.

The toner dropping passage means 48 includes a bellows 66 that is an expansion/contraction means and is so disposed as to extend substantially along the moving direction (vertical direction) of the developing mechanism 6. The toner dropping passage means 48 also includes the connecting housing 68 which is disposed between the upper end portion of the cylindrical member 44 and an upper end portion of the bellows 66 and which serves to drop toner conveyed to the upper end portion of the cylindrical member 44 into the bellows 66; and a connecting pipe means 70 which is disposed between a lower end portion of the bellows 66 and the developing mechanism 6 and which serves to drop toner that has fallen into the bellows 66 to the inside of the developing mechanism 6.

The connecting housing 68 has a cylindrical portion 72 into which the upper end portion of the cylindrical member 44 is inserted for connection at a lower part of its one end portion, and has at the other end portion another cylindrical portion 74 over which the upper end portion of the bellows 66 is fitted for connection. Said another cylindrical portion 74 protrudes and is open into the inside of the bellows 66. The cylindrical portions 72 and 74 are so formed as to extend substantially vertically downwardly. The upper end portion of the connecting housing 68 has a flat opening portion, and a filter 76 as a ventilating means covering the opening portion. Importantly, the filter 76 permits ventilation between the inside of the toner dropping passage means 48 and the atmosphere, but does not allow toner to discharge. An example of the filter 76 is Kanai Heavy Industries' filter marketed under the trade name (model) HF180. The filter 76 also needs to be provided within the toner dropping passage means 48 at a portion where toner minimally adheres, or at a portion where the amount of toner is as small as possible. In this embodiment, therefore, the filter 76 is provided at the top end position of the toner dropping passage means 48. It goes without saying that the filter 76 as a ventilating means may be provided in any part of the toner dropping passage means 48, such as the connecting housing 68, bellows 66, or connecting pipe means 70.

Within the connecting housing 68, an inclined surface 78 is formed extending from a lower end position of the toner outlet opening 65 to said another cylindrical portion 74, so that toner which has come in from the toner outlet opening 65 formed at the upper end portion of the cylindrical member 44 can easily fall into said another cylindrical portion 74.

The connecting pipe means 70 is connected at its upper end portion to the lower end portion of the bellows 66, and at its lower end portion to the development housing 12 of the developing mechanism 6. The lower end portion of the connecting pipe means 70 is situated, and is open, above the toner receiving opening 26 in the development housing 12.

As is apparent from FIG. 2, the bellows 66 is so disposed that its central axis heads in the vertical direction. Therefore, the bellows 66 is constituted such that it can expand and contract vertically, without bending, by the reciprocating movement of the movable frame member (accordingly, the developing mechanism 6). According to this embodiment, the central axis of the bellows 66 is located between the right end of the developing mechanism 6 (FIG. 2) and the cylindrical member 44. Thus, the connecting pipe means 70 has a vertical portion having a central axis consistent with the central axis of the bellows 66, and an inclined portion extending from the vertical portion to the toner receiving opening 26 of the development housing 12.

In connection with the other toner feeding means 36, 38 and 42, the altitudes of the developing mechanisms 10, 4 and 8 relevant thereto are different from each other as illustrated. In correspondence with these different altitudes, the lengths of the respective connecting pipe means 70 are different from each other. The bellows 66 may be constituted such that its central axis is situated immediately above the toner receiving opening 26 only in the case of the developing mechanism 4 located at the uppermost position.

Next, the actions of the multicolor developing device 2 with the above constitution will be described.

Figure 3:
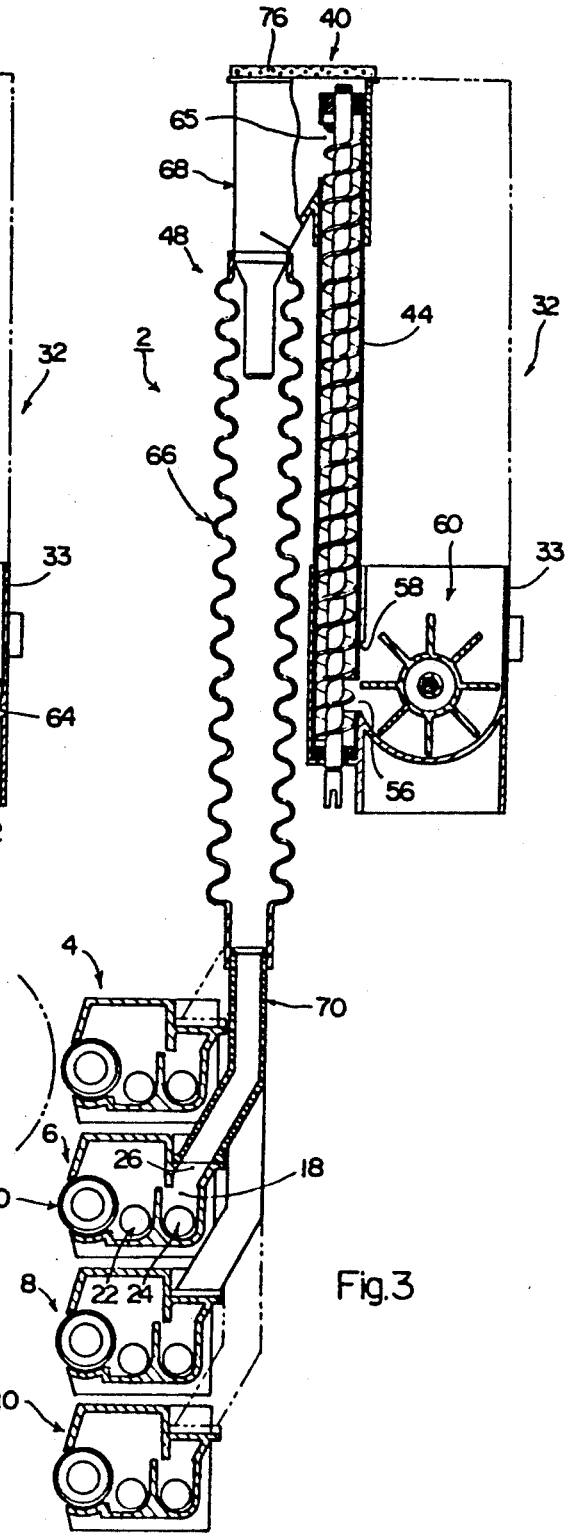
FIG. 3 is a view showing another operating state in FIG. 2.

In accordance with the copying operation of, say, a color image copying machine (not shown) including the multicolor developing device 2, the movable frame member moves reciprocatingly vertically by the moving means. Each of the developing mechanisms 4 to 10 is controlled by a controlling means well known to people skilled in the art so that it will be positioned selectively at a predetermined developing position to perform a developing action in an individually different color. FIG. 2 shows the state in which the movable frame member is situated at the uppermost position, and the developing mechanism 10 located at the lowest position of the movable frame member is positioned at the developing position. FIG. 3 shows the state in which the movable frame member has moved to its lowermost position, and the developing mechanism 4 located at the highest position of the movable frame member is positioned at the developing position.

The developing action of the respective developing mechanisms 4 to 10 and the action of the associated toner feeding means 36 to 42 are each substantially the same. Hence, such actions will be described below in regard to the developing mechanism 6 and the associated toner feeding means 40 of which constitutions have already been described in the embodiment.

When the developing mechanism 6 is not positioned at a predetermined developing position (when the movable frame member is moving or stopped), the developing mechanism 6 is in a non-operating state. The sleeve 20 and spiral rollers 22 and 24 of the developing mechanism 6 are at a stop. Since a toner feeding signal for the developing mechanism 6 has not been generated, the motor Ml for the spiral roller 46 and the motor M for the rotating blade means 60 are inoperative, so that the spiral roller 46 and the rotating blade means 60 are also at a stop. Thus, toner within the toner container 32 is not fed to the developing mechanism 6.

When the movable frame member is moved by the moving means and the developing mechanism 6 is positioned at a predetermined developing position, the developing mechanism 6 is brought into an operating state. The sleeve 20 and spiral rollers 22 and 24 of the developing mechanism 6 are rotated by the driving source, whereby a well-known developing action is performed on the rotating drum. Moreover, a toner feeding signal from the developing mechanism 6 is generated, and so the motor Ml for the spiral roller 46 and the motor M for the rotating blade means 60 are operated. Thus, the spiral roller 46 and the rotating blade means 60 are rotated. Toner within the container body 33 is supplied into the lower end portion of the cylindrical member 44 by the rotating blade means 60 via the opening 58 and the toner inlet opening 56. The toner supplied into the lower end portion of the cylindrical member 44 is conveyed to the upper end portion of the cylindrical member 44 by the spiral roller 46, and discharged into the connecting housing 68 through the toner outlet opening 65. The toner discharged into the connecting housing 68 is fallen along the inclined surface 78, further dropped inside the bellows 66 and the connecting pipe means 70, and fed into the chamber 18 of the developing mechanism 6 through the toner receiving opening 26 of the development housing 12.

When the predetermined developing action of the developing mechanism 6 is completed, the movable frame member starts movement, whereby one of the other developing mechanisms 4, 8 and 10 is selected and positioned at a predetermined developing position. For any of the developing mechanism 4, 8 and 10, substantially the same action as described above will be performed. During this period, the developing mechanism 6 is returned to a non-operating state.

Regardless of the operation and non-operation of the developing mechanism 6, the bellows 66 is expanded and contracted in the moving direction of the developing mechanism 6 (the vertical direction in this embodiment) without being bent, in accordance with the movement of the movable frame member. This expansion/contraction operation produces a suction pressure and an exhaust pressure within the toner dropping passage means 48 including the bellows 66. The suction pressure and the exhaust pressure are controlled via the filter 76 provided at the top end portion of the connecting housing 68. At exhaust via the filter 76, only air is exhausted, and toner is caught by the filter 76 and not scattered in the atmosphere. Such action is similarly performed by any of the other toner dropping passage means.

In the present invention, the toner containers are described as being provided in the same number as the number of the developing mechanisms. The invention also includes a single toner container using two toner cartridges. Specifically, in the case of a toner container with a black toner used in a relatively large amount, there is only one toner hopper (not shown) corresponding to the container body 33 indicated in the embodiment. Two toner cartridges (not shown), however, may be provided detachably on the toner hopper. The expression "the same number of toner containers as the number of the developing mechanisms" in this invention is taken to include such an example.

This invention that has been described based on the above embodiment affords the following advantages.

(1) Since the toner containers are disposed in a fixed manner, no space is required for the upward movement of the toner containers. Thus, there are few spatial restrictions for the toner containers, a sufficient volume of the toner containers can be secured, and the color image forming machine can be made compact in size. In addition, the frequency of toner feedings into the toner containers can be reduced, thus decreasing burden on the operator and bringing sanitary advantages.

Moreover, it is not necessary to locate the toner containers further upward of the developing mechanisms. Thus, the height of the color image forming machine can be made small, also contributing to the compactness of the color image forming machine. Furthermore, there arises no useless space below the toner containers. In other words, an effective space can be secured below the toner containers.

(2) Compared with the type in which the toner containers are provided on the movable frame member, the weight of the movable frame member can be considerably reduced in the device of the invention. Therefore, inertia force owing to the movement of the movable frame member is small, and load on the moving means for the movable frame member becomes also small. Consequently, it becomes easy to deal with problems facing high-speed operation, and so changeover among the respective developing mechanisms can be quickened, contributing to the high-speed operation of the color image forming machine. Also, the motor as a driving source for the moving means can be made small in size.

(3) The volume of toner remaining within the toner containers does not vary. Therefore, the load on the moving means at the driving and stopping of the movable frame member is substantially constant. Thus, the positioning of each developing mechanism and the timing of operating and stopping the movable frame member can be made in full accuracy.

(4) Since each toner container can be formed into a longitudinal shape, toner placed therein can fall in the toner container under its own weight. Therefore, it is not necessary to provide within the toner container a mechanism for forcing dropping of toner by shaking. The constitution of the toner container can be simplified and made inexpensive.

(5) The toner dropping passage means connecting the upper end portion of the cylindrical member to the developing mechanism is provided and is constituted so as to include an expansion/contraction means capable of extending substantially along the moving direction of the developing mechanism. Thus the movable frame member (developing mechanisms) can be moved without undergoing load. A smooth movement of the movable frame member is thus ensured, and it is possible to achieve a low-capacity driving source for the moving means and a high-accuracy positioning of the developing mechanism.

(6) When the toner dropping passage means is provided with a ventilating means, including a filter means, for making the inside of the toner dropping passage means and the atmosphere communicate with each other, air can be smoothly sucked into and discharged from the expansion/contraction means. Hence, the effect of (5) can be further enhanced. Moreover, an exhaust pressure generated at the contraction of the expansion/contraction means permits air within the toner dropping passage means to be exhausted by the ventilating means, whereas toner is surely caught by the filter means. Accordingly, toner can be prevented from scattering to the outside of the developing machine, whereby the contamination of the surroundings with toner can be prevented.

In addition, air generated at the contraction of the expansion/contraction means can be prevented from ejecting from the gap between the developing mechanism and the sleeve. Therefore, an accurate developing action is ensured, and the ambient environment is not contaminated.

(7) When the expansion/contraction means is composed of a bellows, the bellows expands and contracts in the moving direction of the developing mechanism, without bending, in accordance with the movement of the movable frame member (developing mechanism). Therefore, toner within the bellows is smoothly fed into the developing mechanism after spontaneously falling. Toner trapped within the bellows is shaken off by the expanding/contracting motion and dropped into the developing mechanism. Thus, the blocking of toner within the bellows is automatically prevented.

(8) When a rotating blade means for forcing toner held in the toner container into the lower end portion of the cylindrical member is provided in the lower end portion of the toner container, toner is effectively supplied from the toner container into the cylindrical member, thus smoothing the feeding of toner from the toner container into the developing mechanism.

Moreover, agglomeration of toner within the toner container can also be prevented.

In the foregoing description, this invention has been described in detail by way of an embodiment, but it is in no way limited to the above embodiment, but may be modified or altered variously without departing from the scope of the invention.

What we claim is

1. A multicolor developing device comprising a stationary frame member, a movable frame member so mounted on the stationary frame member as to be moved reciprocatingly in a vertical direction by a moving means, and a number of developing mechanisms spaced in a predetermined direction and mounted on the movable frame member so as to be vertically movable therewith, each of the developing mechanisms being selectively positioned at a predetermined developing position when the movable frame member has been moved by the moving means, so that each developing mechanism performs developing in a different color, wherein a number of toner containers which is the same as the number of developing mechanisms are arranged in a fixed manner, a toner feeding means for feeding a toner held within a toner container into a developing mechanism is provided between each of the toner containers and each of the developing mechanisms corresponding to the toner containers, each of the toner feeding means includes a cylindrical member extending upwardly from a lower end portion of the toner container in the vertical direction, a toner conveying means which is disposed within the cylindrical member and extends therealong and which is adapted to convey toner that has been supplied to the cylindrical member from the lower end portion of the toner container, to an upper end portion of the cylindrical member, and a toner dropping passage means for connecting the upper end portion of the cylindrical member to the developing mechanism and feeding the toner conveyed to the upper end portion of the cylindrical member into the developing mechanism, each toner conveying means is connected with a driving source which is actuated based on a toner feeding signal, each toner dropping passage means includes an expansion/contraction means adapted to extend substantially along the vertical moving direction of the developing mechanisms, and each expansion/contraction means is so constructed as to be expansible and contractible in the vertical moving direction of the developing mechanisms in accordance with the reciprocating movement of the movable frame member.

2. The multicolor developing device according to claim 1, wherein the toner conveying means is constructed of a spiral roller provided rotatably within the cylindrical member.

3. The multicolor developing device according to claim 1, wherein expansion/contraction means is constructed of a bellows.

4. The multicolor developing device according to claim 1, wherein the toner dropping passage means includes a connecting housing which is disposed between the upper end portion of the cylindrical member and an upper end portion of the expansion/contraction means and which is adapted to drop toner conveyed to the upper end portion of the cylindrical member into the expansion/contraction means, and a connecting pipe means which is disposed between a lower end portion of the expansion/contraction means and the developing mechanism, and a toner outlet opening, for discharging the toner conveyed to the upper end portion of the cylindrical member into the connecting housing, is formed at the upper end portion of the cylindrical member.

5. A multicolor developing device comprising a stationary frame member, a movable frame member so mounted on the stationary frame member as to be movable reciprocating in a predetermined direction by a moving means, and a number of developing mechanisms spaced in the predetermined direction and mounted on the movable frame member, each of the developing mechanisms being selectively positioned at a predetermined developing position when the movable frame member has been moved by the moving means, so that each developing mechanism performs developing in a different color, wherein a number of toner containers which is the same as the number of developing mechanisms are arranged in a fixed manner, a toner feeding means for feeding a toner held within a toner container into a developing mechanism is provided between each of the toner containers and each of the developing mechanisms corresponding to the toner containers, each of the toner feeding means includes a cylindrical member extending upwardly from a lower end portion of the toner container in the predetermined direction, a toner conveying means which is disposed within the cylindrical member and extends therealong and which is adapted to convey toner that has been supplied to the cylindrical member from the lower end portion of the toner container, to an upper end portion of the cylindrical member, and a toner dropping passage means for connecting the upper end portion of the cylindrical member with the developing mechanism and feeding the toner conveyed to the upper end portion of the cylindrical member into the developing mechanism, each toner conveying means is connected with a driving source which is actuated based on a toner feeding signal, each toner dropping passage means includes an expansion/contraction means adapted to extend substantially along the moving direction of the developing mechanisms, each expansion/contraction means is so constructed as to be expansible and contractible in the moving direction of the developing mechanisms in accordance with the reciprocating movement of the movable frame member, and a ventilating means, including a filter, for performing ventilation between the inside of the toner dropping passage means and the atmosphere is provided in the toner dropping passage means.

6. The multicolor developing device according to claim 5, wherein the ventilating means is provided substantially at a top end position of the toner dropping passage means.

7. The multicolor developing device according to claim 5, wherein the toner dropping passage means includes a connecting housing which is disposed between the upper end portion of the cylindrical member and an upper end portion of the expansion/contraction means and which is adapted to drop toner conveyed to the upper end portion of the cylindrical member into the expansion/contraction means, and a connecting pipe means which is disposed between a lower end portion of the expansion/contraction means and the developing mechanism and which is adapted to drop toner which has fallen into the expansion/contraction means into the developing mechanism, and the ventilating means is provided in the connecting housing.

8. A multicolor developing device comprising a stationary frame member, a movable frame member so mounted on the stationary frame member as to be movable reciprocatingly in a vertical direction by a moving means, and a number of developing mechanisms spaced in a predetermined direction and mounted on the movable frame member, each of the developing mechanisms being selectively positioned at a predetermined developing position when the movable frame member has been moved by the moving means, so that each developing mechanism performs developing in a different color, wherein a number of toner containers which is the same as the number of developing mechanisms are arranged in a fixed manner, a toner feeding means for feeding a toner held within a toner container into a developing mechanism is provided between each of the toner containers and each of the developing mechanisms corresponding to the toner containers, each of the toner feeding means includes a cylindrical member extending upwardly from a lower end portion of the toner container in the vertical direction, a toner conveying means which is disposed within the cylindrical member and extends therealong and which is adapted to convey toner that has been supplied to the cylindrical member from the lower end portion of the toner container, to an upper end portion of the cylindrical member, and a toner dropping passage means for connecting the upper end portion of the cylindrical member to the developing mechanism and feeding the toner conveyed to the upper end portion of the cylindrical member into the developing mechanism, each toner conveying means is connected with a driving source which is actuated based on a toner feeding signal, each toner dropping passage means includes an expansion/contraction means adapted to extend substantially along the vertical moving direction of the developing mechanisms, each expansion/contraction means is so constructed as to be expansible and contractible in the vertical moving direction of the developing mechanisms in accordance with the reciprocating movement of the movable frame member, and a rotating blade means for forcing toner held in the toner container into the lower end portion of the cylindrical member is provided in the lower end portion of the toner container.

9. The multicolor developing device according to claim 8, wherein a toner receiving opening for receiving the toner forced in by the rotating blade means into the lower end portion of the cylindrical member is formed at the lower end portion of the cylindrical member.

* * * * *